US006545582B2

(12) United States Patent
Sato

(10) Patent No.: US 6,545,582 B2
(45) Date of Patent: Apr. 8, 2003

(54) MAGNETIC CORE HAVING AN EFFECTIVE MAGNETIC BIAS AND MAGNETIC DEVICE USING THE MAGNETIC CORE

(75) Inventor: Kunitake Sato, Miyagi (JP)

(73) Assignee: NEC Tokin Corporation, Sendai (JP)

( * ) Notice: Subject to any disclaimer, the term of this patent is extended or adjusted under 35 U.S.C. 154(b) by 0 days.

(21) Appl. No.: 09/943,730

(22) Filed: Aug. 31, 2001

(65) Prior Publication Data

US 2002/0030574 A1 Mar. 14, 2002

(30) Foreign Application Priority Data

Sep. 8, 2000 (JP) ..... 2000-274185

(51) Int. Cl.[7] ..... H01F 21/00

(52) U.S. Cl. ..... 336/110; 336/96; 336/92; 335/213

(58) Field of Search ..... 335/210–213; 315/400; 336/110, 90, 92, 96

(56) References Cited

U.S. PATENT DOCUMENTS 5,473,299 A * 12/1995 Tsutsumi et al. ..... 336/110

FOREIGN PATENT DOCUMENTS

| | | |
|---|---|---|
| EP | 0 431 322 A1 | 6/1991 |
| EP | 0 898 289 A2 | 2/1999 |
| GB | 708133 A | 4/1954 |
| JP | 43-3771 | 2/1943 |

OTHER PUBLICATIONS

Patent Abstracts of Japan, vol. 1997, No. 12, Dec. 25, 1997 and JP 09–213546 A (Yasaka Electric Corp.), Aug. 15, 1997—Abstract only.

Patent Abstracts of Japan, vol. 1999, No. 12, Oct. 29, 1999 and JP 11–186042 (Taiyo Yuden Co. Ltd.), Jul. 9, 1999—Abstract only.

* cited by examiner

*Primary Examiner*—Anh Mai
(74) *Attorney, Agent, or Firm*—Frishauf, Holtz, Goodman & Chick, P.C.

(57) ABSTRACT

A magnetic core (10) is provided with a flange portion (12) protruding outward a winding core portion (11) in a radial direction perpendicular to a center axis (19) of the winding core portion. The winding core portion has an outer peripheral surface (11*a*) which surrounds the center axis to have a first distance (d1) therebetween. The flange portion is provided with a permanent magnet (15) apart from the center axis by a second distance (d2) greater than the first distance.

8 Claims, 3 Drawing Sheets

MAGNETIC CORE HAVING AN EFFECTIVE MAGNETIC BIAS AND MAGNETIC DEVICE USING THE MAGNETIC CORE

BACKGROUND OF THE INVENTION:

This invention relates to a magnetic core for use in an electronic apparatus and to a magnetic device comprising the magnetic core and a winding wound around the magnetic core.

A typical magnetic device such as a choke coil or a transformer comprises a magnetic core such as a drum-shaped core block made of a magnetic material and a winding wound around the magnetic core. In order to achieve the reduction in size and weight of the magnetic device, it is effective to reduce the volume of the magnetic core, as known in the art. However, the magnetic core reduced in size is readily saturated in magnetization. As a result, an acceptable current level is inevitably decreased.

In order to solve the above-mentioned problem, use has been made of an approach of forming a gap at a part of the magnetic core to increase a magnetic resistance so that the acceptable current level is prevented from being decreased. This approach is, however, disadvantageous because a magnetic inductance as an inherent characteristic value of the magnetic device is reduced.

On the other hand, Japanese Examined Utility Model Publication No. S43-3771 (JP 43-3771 Y) discloses a flyback transformer utilizing another approach. Referring to FIG. 1, description will hereinafter be made of a magnetic device corresponding to the flyback transformer. The magnetic device illustrated in FIG. 1 comprises a magnetic core 1 and a winding 2 wound around the magnetic core 1. The magnetic core 1 has a winding core portion 3 having an outer peripheral surface having a circular cylindrical shape to receive the winding 2, and a pair of flange portions 4 and 5 integrally coupled to opposite ends of the winding core portion 3 in its axial direction respectively. The magnetic core 1 has an axial one end provided with a disk-shaped permanent magnet 6 attached thereto. The permanent magnet 6 is magnetized in its thickness direction, i.e., in an axial direction of the magnetic core 1. In this manner, the magnetic core 1 is applied with a DC magnetic bias by the permanent magnet 6 in order to prevent magnetic saturation of the magnetic core 1.

Referring to FIG. 2, description will be made of the magnetic bias in the magnetic device illustrated in FIG. 1. The permanent magnet 6 generates a DC magnetic field 7. When the winding 2 is energized, an AC magnetic field 8 is generated. Since the permanent magnet 6 has a disk shape, the magnetic bias applied by the permanent magnet 6 is concentrated to the winding core portion 3. On the other hand, the flange portions 4 and 5 are hardly applied with the magnetic bias. Therefore, the above-mentioned approach is insufficient to prevent the decrease in saturation flux density resulting from the reduction in size of the magnetic core.

SUMMARY OF THE INVENTION

It is therefore an object of this invention to provide a magnetic core capable of effectively preventing, by a magnetic bias, the decrease in saturation flux density resulting from the reduction in size of the magnetic core.

It is another object of this invention to provide a magnetic core of the type mentioned above, which can be reduced in cost, size, and weight.

It is still another object of this invention to provide a magnetic device comprising the above-mentioned magnetic core.

Other objects of the present invention will become clear as the description proceeds.

According to the present invention, there is provided a magnetic core which comprises a winding core portion having a center axis and an outer peripheral surface which surrounds said center axis to have a first distance therebetween, and a flange portion coupled to the winding core portion and protruding outward the winding core portion in a radial direction perpendicular to the center axis. The flange portion has a permanent magnet apart from the center axis by a second distance greater than the first distance.

According to the present invention, there is provided a magnetic device which comprises the magnetic core and a winding wound around the winding core portion of the magnetic core.

DESCRIPTION OF THE PREFERRED EMBODIMENTS

Figure 1:
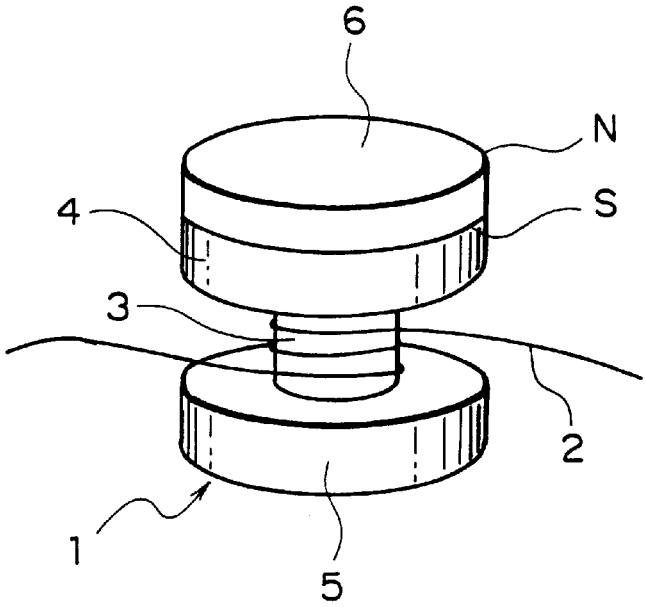
(PRIOR ART) FIG. 1
FIG. 1 is a perspective view of an existing magnetic device.
Figure 2:
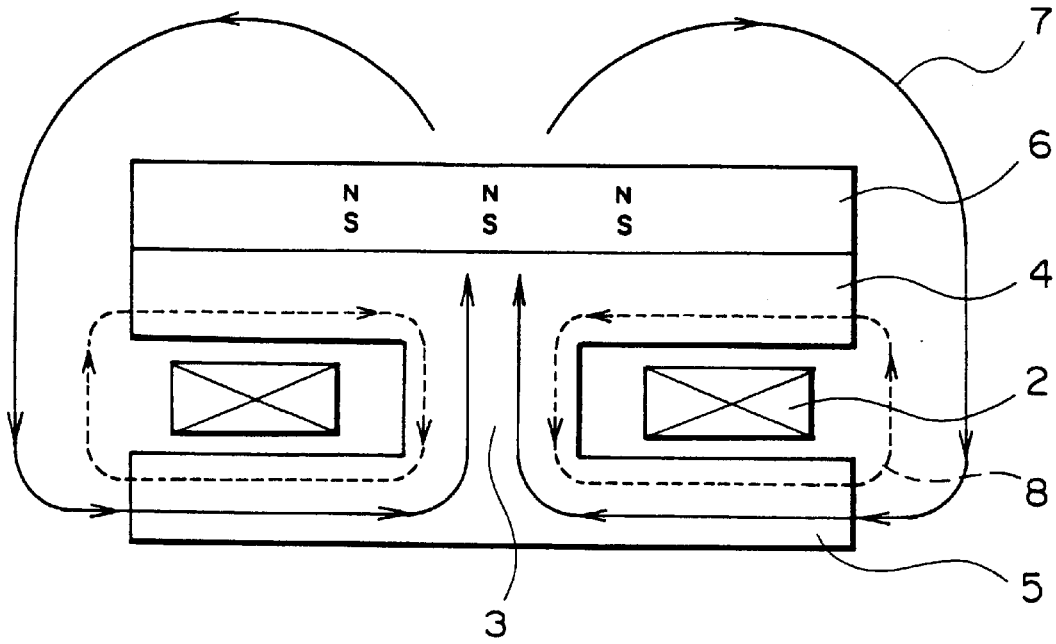
(PRIOR ART) FIG. 2
FIG. 2 is a view for describing a magnetic biasing effect in the magnetic device illustrated in FIG. 1.
Figure 3:
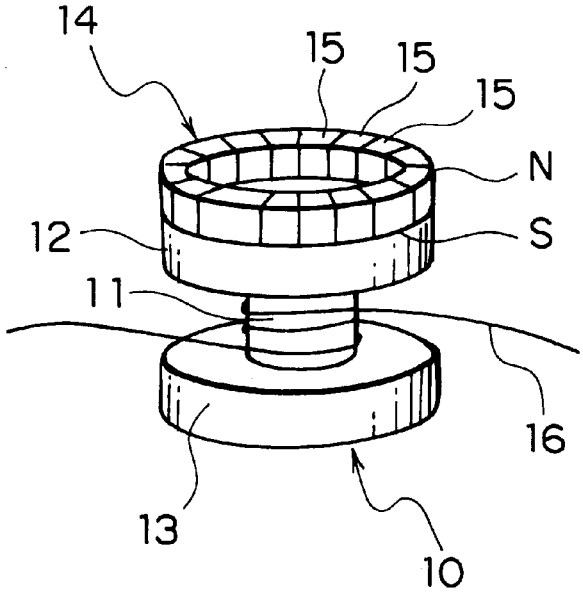
FIG. 3 is a perspective view of a magnetic device according to a first embodiment of this invention.

Referring to FIG. 3, description will be made of a magnetic device according to a first embodiment of this invention.

The magnetic device illustrated in FIG. 3 includes a magnetic core 10 comprising a drum-shaped core block having a circular section. The magnetic core 10 has a winding core portion 11 having an outer peripheral surface of a circular cylindrical shape, and a pair of flange portions 12 and 13 integrally coupled to opposite ends of the winding core portion 11 in its axial direction, respectively, and protruding outward in a radial direction of the winding core portion 11. One flange portion 12 is provided with a permanent magnet 14 attached to its outer surface.

The permanent magnet 14 extends in a circumferential direction, centered on a center axis of the winding core portion 11, to form a circular ring shape so as to be located only in an area outside the outer peripheral surface of the winding core portion 11 in the radial direction. The permanent magnet 14 of the above-mentioned shape is formed by arranging a number of magnet elements 15 in contact with one another in the circumferential direction. Each magnet element 15 is magnetized in the axial direction of the winding core portion 11 and has an N pole and an S pole.

Furthermore, the winding core portion 11 of the magnetic core 10 is provided with a winding 16 wound therearound to form the magnetic device. The magnetic device thus obtained serves as a choke coil applied with a magnetic bias. In the magnetic device, the permanent magnet 14 has a ring shape and is reduced in volume. Therefore, it is possible to reduce the weight and to save the material cost.

Figure 4:
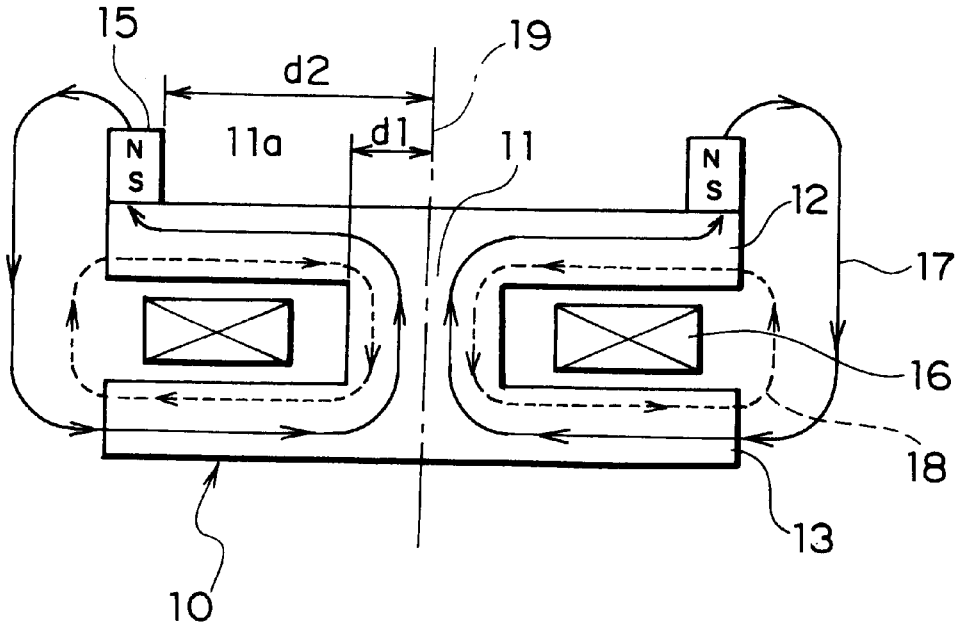
FIG. 4 is a view for describing a magnetic bias applied in the magnetic device illustrated in FIG. 3.

Referring to FIG. 4, description will be made of the magnetic bias in the magnetic device illustrated in FIG. 3. The permanent magnet 14 generates a DC magnetic field 17 known in the art. When the winding 16 is energized, an AC magnetic field 18 is generated in the manner known in the art.

The permanent magnet 14 is disposed only in the area outside the winding core portion 11 in the radial direction so as not to face the winding core portion 11 as a center axis 19 of the magnetic core 10. More particularly, while the outer peripheral surface 11*a* of the winding core portion 11 surrounds the center axis 19 to have a first distance d1 therebetween, the permanent magnet 12 is apart from the center axis 19 by a second distance d2 greater than the first distance d1.

With this structure, the DC magnetic field 17 does not concentrate only to the winding core portion 11 of the magnetic core 10 but sufficiently acts upon the flanges 12 and 13. Thus, the magnetic bias is applied throughout a whole of the magnetic core 10 to thereby promote the magnetic biasing effect.

Figure 5:
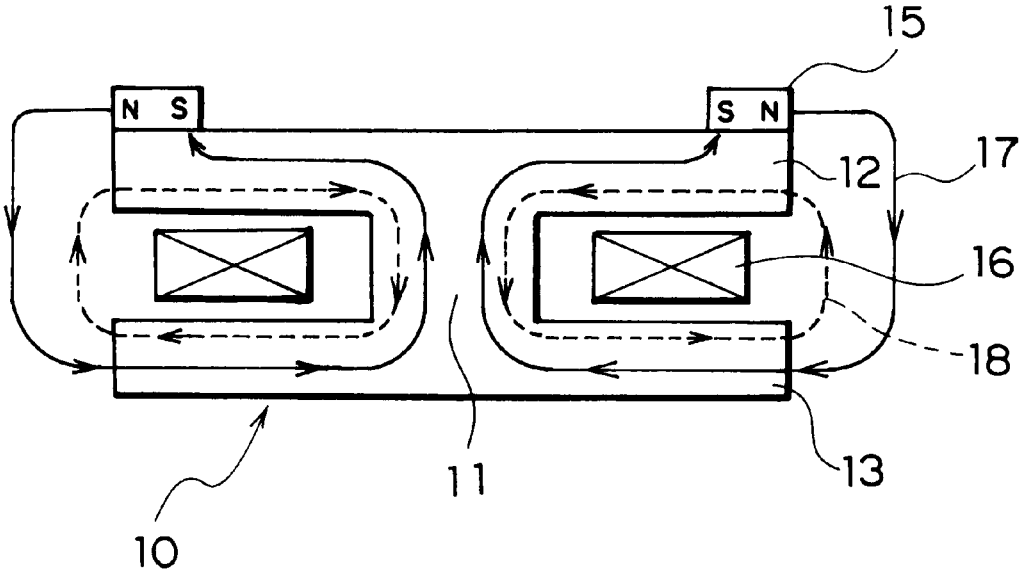
FIG. 5 is a view for describing the magnetic bias applied in a different manner.

Referring to FIG. 5, the permanent magnet 14 may be magnetized in the radial direction of the winding core portion 11. In this case, the DC magnetic field 17 is applied in a slightly different manner, as illustrated in the figure. From comparison of FIGS. 4 and 5, it will be understood that the magnetic bias is applied in a substantially similar manner even if the permanent magnet 14 is magnetized in the different direction. Therefore, the direction of magnetization of the permanent magnet 14 is not restricted.

Figure 6:
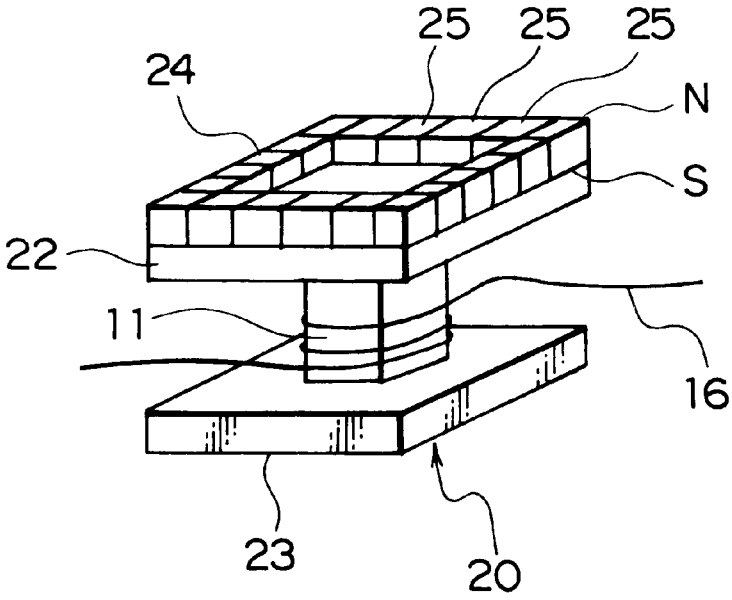
FIG. 6 is a perspective view of a magnetic device according to a second embodiment of this invention.

Referring to FIG. 6, description will be made of a magnetic device according to a second embodiment of this invention.

The magnetic device illustrated in FIG. 6 includes a magnetic core 20 comprising a drum-shaped core block having a rectangular section. The magnetic core 20 has a winding core portion 21 having an outer peripheral surface of a rectangular cylindrical shape, and a pair of flange portions 22 and 23 integrally coupled to opposite ends of the winding core portion 21 in its axial direction, respectively, and protruding outward in a radial direction of the winding core portion 21. One flange portion 22 is provided with a permanent magnet 24 attached to its outer surface.

The permanent magnet 24 extends in the circumferential direction to form a rectangular ring shape so as to be located only in an area outside the outer peripheral surface of the winding core portion 21 in the radial direction. The permanent magnet 24 of the above-mentioned shape is formed by arranging a number of magnetic elements 25 in contact with one another in the circumferential direction. Each magnetic element 25 is magnetized in the axial direction of the winding core portion 21 and has an N pole and an S pole.

Furthermore, the winding core portion 21 of the magnetic core 20 is provided with a winding 26 wound therearound to form the magnetic device. The magnetic device thus obtained serves as a choke coil applied with a magnetic bias. In the magnetic device, the permanent magnet 24 has a ring shape and is reduced in volume. Therefore, it is possible to reduce the weight and to save the material cost.

The magnetic bias in the magnetic device illustrated in FIG. 6 is similar to that in the magnetic device illustrated in FIG. 3. Specifically, the DC magnetic field by the permanent magnet 24 does not concentrate only to the winding core portion 21 of the magnetic core 20 but sufficiently acts upon the flange portions 22 and 23. Therefore, the magnetic bias is applied throughout a whole of the magnetic core 20 to thereby promote the magnetic biasing effect.

It will readily be understood that the permanent magnet 24 may be magnetized in the radial direction of the winding core portion 21.

While the present invention has thus far been described in connection with a few embodiments thereof, it will readily be possible for those skilled in the art to put this invention into practice in various other manners. For example, the permanent magnet may comprise a single permanent magnet and may be magnetized in the radial direction of the winding core portion. In addition, this invention is applicable not only to the choke coil but also to other magnetic devices such as a transformer.

What is claimed is:

1. A magnetic core comprising:

a winding core portion having a center axis and an outer peripheral surface which surrounds said center axis to have a first distance therebetween; and a flange portion coupled to said winding core portion and protruding outward said winding core portion in a radial direction perpendicular to said center axis, said flange portion having a permanent magnet apart from said center axis by a second distance greater than said first distance.

2. A magnetic core according to claim 1, wherein said permanent magnet extends in a circumferential direction centered on said center axis.

3. A magnetic core according to claim 2, wherein said permanent magnet has a circular ring shape.

4. A magnetic core according to claim 2, wherein said permanent magnet has a rectangular ring shape.

5. A magnetic core according to claim 2, wherein said permanent magnet comprises a plurality of magnetic elements arranged in contact with one another in said circumferential direction.

6. A magnetic core according to claim 1, wherein said permanent magnet is magnetized in an axial direction parallel to said center axis.

7. A magnetic core according to claim 1, wherein said permanent magnet is magnetized in said radial direction.

8. A magnetic device comprising:

the magnetic core according to claim 1; and a winding wound around the winding core portion of said magnetic core.

* * * * *